United States Patent [19]

Kobayashi

[11] Patent Number: 4,760,814

[45] Date of Patent: Aug. 2, 1988

[54] COMPONENT LAYOUT FOR SMALL WATERCRAFT

[75] Inventor: Noboru Kobayashi, Kosai, Japan

[73] Assignee: Yamaha Hatsudoki Kabushiki Kaisha, Iwata, Japan

[21] Appl. No.: 935,337

[22] Filed: Nov. 26, 1986

[30] Foreign Application Priority Data

Nov. 26, 1985 [JP] Japan ..... 60-265886

[51] Int. Cl.[4] ..... B63B 35/00

[52] U.S. Cl. ..... 114/270

[58] Field of Search ..... 114/270, 121

[56] References Cited

U.S. PATENT DOCUMENTS

| | | | |
|---|---|---|---|
| 3,826,220 | 7/1974 | Jacobson | 114/270 |
| 4,635,582 | 1/1987 | Nishida | 114/270 X |
| 4,664,054 | 5/1987 | Nishida | 114/270 |

*Primary Examiner*—Galen Barefoot
*Assistant Examiner*—Paul E. Salmon
*Attorney, Agent, or Firm*—Ernest A. Beutler

[57] ABSTRACT

A component layout for a small boat that improves the balance by positioning all of the heavy components in close proximity to the center of the watercraft with the engine being positioned substantially at the watercraft center of gravity.

4 Claims, 2 Drawing Sheets

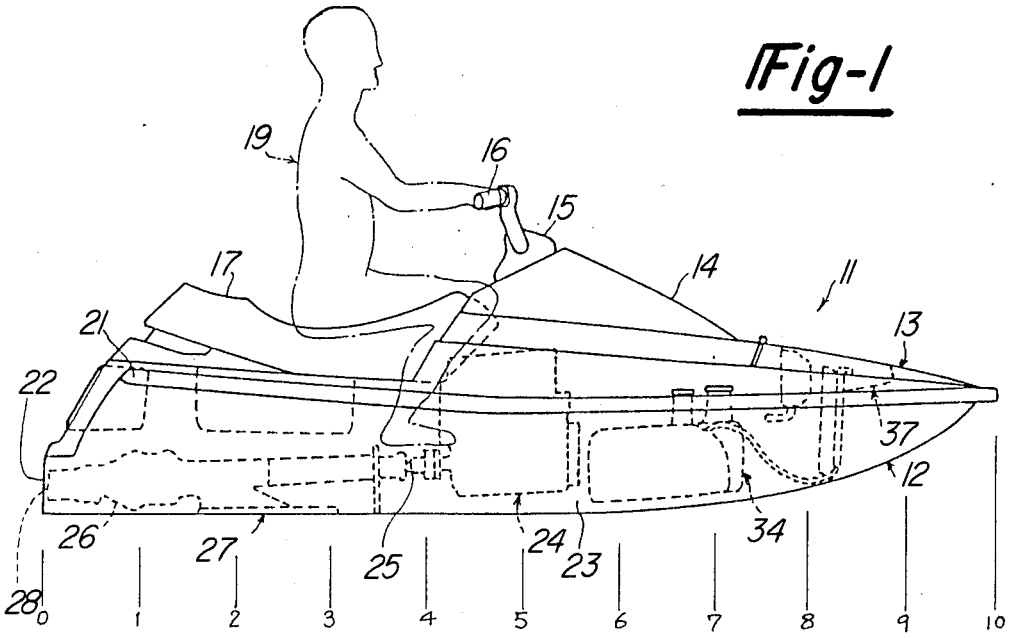
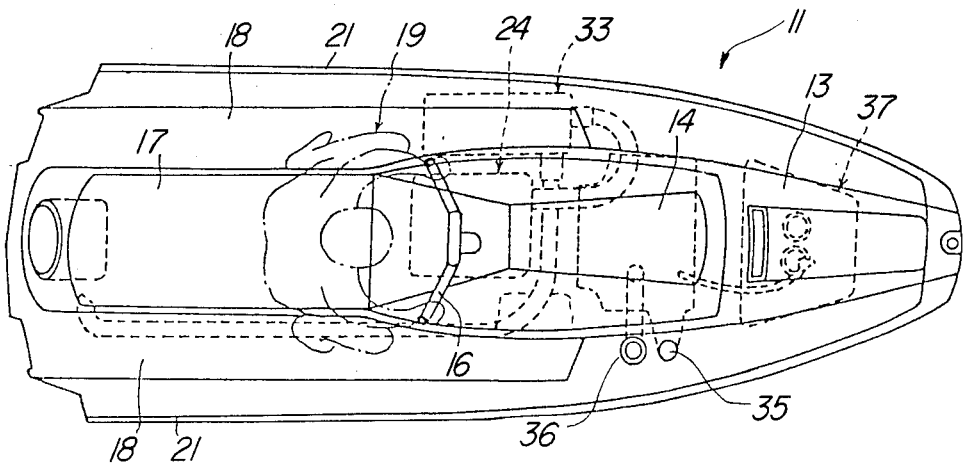
Fig-2

COMPONENT LAYOUT FOR SMALL WATERCRAFT

BACKGROUND OF THE INVENTION

This invention relates to a component layout for small watercraft and more particularly to an arrangement for locating the components of a small watercraft in such a manner as to provide good balance.

A popular form of small watercraft embodies a jet propulsion unit for powering the watercraft and is designed primarily to be ridden by a single rider. This type of watercraft is highly maneuverable and offers great entertainment for the riders. However, the degree of satisfaction with the riding of the watercraft is related directly to the handling or maneuverability of the watercraft. Because of the compact nature of this type of watercraft, it is necessary that the balance be very good regardless of the weight of the operator riding it. In order to insure this, it is, therefore, desirable to try to locate the weight of the major components such as the engine, fuel tank, battery and jet propulsion unit in such a way as to achieve this balance.

It is, therefore, an object of this invention to provide an improved component layout for a small watercraft.

It is a further object of this invention to provide a component layout for a small watercraft in which the balance of the watercraft is improved and wherein the watercraft is less sensitive to variations in the weight of the rider.

SUMMARY OF THE INVENTION

This invention is adapted to be embodied in a small watercraft having a hull, a driving engine, a jet propulsion unit driven by the engine, and a plurality of auxiliaries for operating the engine and the watercraft. In accordance with the invention, the engine and jet propulsion unit are located on the longitudinal center line of the watercraft and the other major components are clustered around the engine on its opposite sides so as to maintain good balance.

BRIEF DESCRIPTION OF THE DRAWINGS

FIG. 1 is a side elevational view of a small watercraft constructed in accordance with an embodiment of the invention.

FIG. 2 is a top plan view of the watercraft.

DETAILED DESCRIPTION OF THE PREFERRED EMBODIMENT

Figure 3:
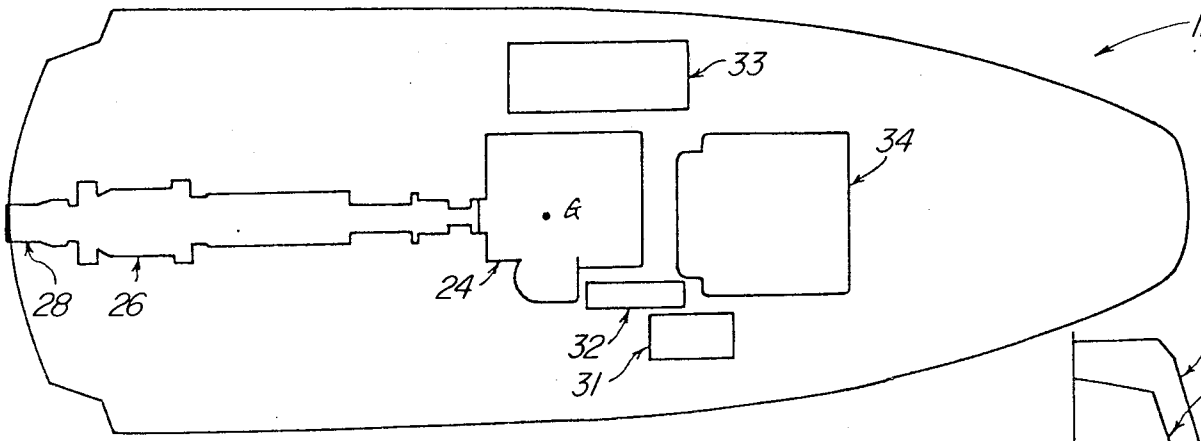
FIG. 3 is a top plan view, with the cover removed, and showing the layout of the major components.
Figure 4:
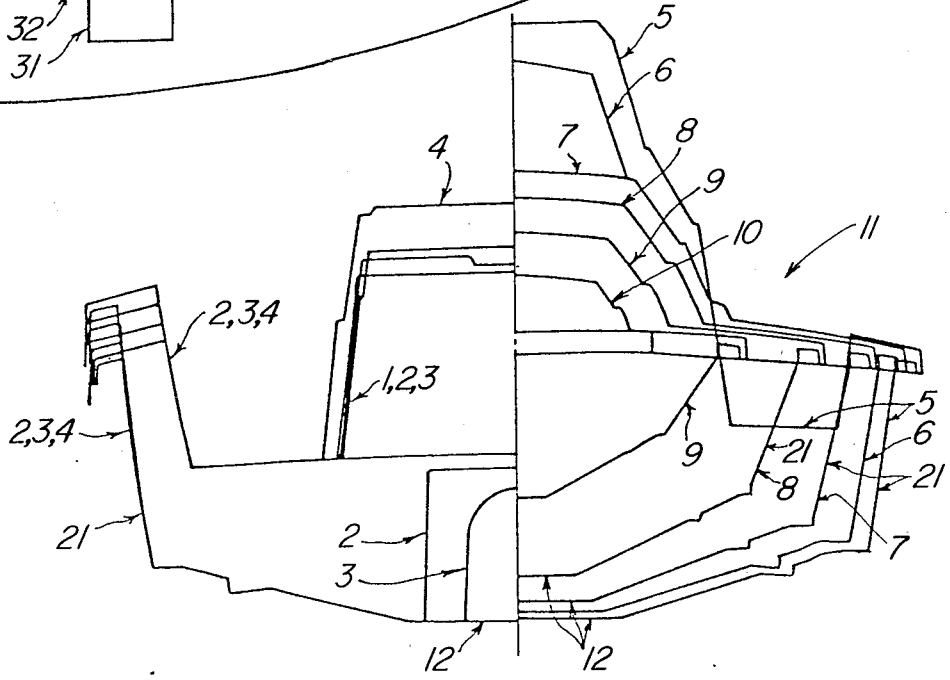
FIG. 4 is a view showing the overall configuration of the watercraft through a plurality of sections taken along the lines 0 through 10 inclusive of FIG. 1 and on an enlarged scale.

The reference numeral 11 indicates a small watercraft constructed in accordance with an embodiment of the invention. The watercraft 11 is comprised of a hull 12 and a deck 13 that is affixed in a suitable manner to the hull 12. The hull 12 and deck 13 are formed of a fiber glass reinforced plastic of the type normally used in this art. Centrally of the watercraft, the deck 13 is provided with an engine compartment opening that is closed by a removable hatch 14. The hatch, in turn, carries a steering support 15 which, in turn, journals a steering handlebar 16 for steering of the watercraft.

Positioned rearwardly of the handlebar 16 and formed by the deck 13 is a rider's area comprised of a seat 17 that is designed to accommodate a single rider in a straddle fashion. The rider's area also includes a pair of foot wells 18 are formed on opposite sides of the seat 17 so as to accommodate the legs of a rider, indicated by the reference numeral 19 and shown in phantom in FIGS. 1 and 2. The outer periphery of the foot wells 18 is defined by a pair of raised gunnels 21 formed by the hull 12 and deck 13. The foot wells 18 extend through the rear face of the transom 22 of the watercraft 11.

The hull 12 defines a generally hollow interior or engine compartment 23. A powering internal combustion engine 24 is positioned within the engine compartment 23 and is disposed on the longitudinal center line of the watercraft 11 substantially at the midpoint of the watercraft in the fore and aft direction.

The engine 24 has a drive shaft 25 that is coupled to an input shaft of a jet propulsion unit 26. The jet propulsion unit 26 also lies on the longitudinal center line of the watercraft. Water is delivered to the jet propulsion unit 26 through a downward and forwardly facing water inlet 27. The water is drawn in through the impeller (not shown) which is driven by the engine output shaft 25 and is discharged through a pivotally supported discharge nozzle 28. The discharge nozzle 28 may be pivoted about a vertically extending axis for steering of the watercraft in the manner well known in this art.

It is desirable to maintain the center of gravity of the watercraft 11 at substantially its center to improve handling and to avoid upsetting the watercraft depending upon the weight of the rider 19. To this end, all of the major heavy supporting components of the watercraft 11 are disposed in proximity to the engine 24 and are placed on the sides of it so as to achieve good balance. Thus, a battery 31 and electrical power system 32 which may comprise the generator and starter for the engine 24 are positioned on one side of the engine 24. A water trap device, indicated generally by the reference numeral 33, and which has a weight approximating the combined weight of the battery and electrical devices 32 is disposed on the opposite side of the engine 24. The water trap device is a device that includes an exhaust manifold for receiving the exhaust gases from the engine 24 and water that has been circulated through the engine cooling jacket and discharging them into the body of water in which the watercraft 11 is operating. This trap device, however, is designed so as to prevent the entry of water back into the engine if the watercraft becomes inverted.

A fuel tank 34 is disposed on the longitudinal center line of the watercraft and is disposed just forwardly of the engine 24. Preferably, the weight of the fuel tank 34 and its longitudinal position is designed so as to be balanced by the weight of the jet propulsion unit 26 so that the center of gravity G lies at the center of the watercraft on a horizontal plane as shown in FIG. 3. The fuel tank 34 is provided with a fuel inlet opening 35 and fuel gauge 36 that extend through the upper deck 13 so as to permit ease of refueling and of checking the fuel level of the watercraft.

An air intake chamber 37 is located forwardly of the hull 12 and is designed so as to permit air to be drawn in for the induction system of the engine 24 and other ventilation. In addition, a fuel tank vent opens into this area. The air intake device 37 is also designed so as to provide a trap so that water cannot enter the engine induction system if the watercraft becomes submerged.

It should be readily apparent from the foregoing description that the component layout for the watercraft provides extremely good balance and renders the watercraft relatively insensitive to trim changes in response to differing weights of riders.

It is to be understood that the foregoing description is that of a preferred embodiment of the invention and that various changes and modifications may be made without department from the spirit and scope of the invention, as defined by the appended claims.

I claim:

1. A small watercraft comprising a hull and a deck defining a longitudinal center line and an engine compartment extending transversely across said longitudinal center line, an engine positioned within said engine compartment and lying on said longitudinal center line and at its longitudinal midpoint, a jet propulsion unit positioned rearwardly of said engine and driven by said engine, a single rider's area positioned contiguous to said engine and adapted to accommodate a single rider in straddle fashion, and a plurality of heavy supporting components for said engine juxtaposed longitudinally adjacent to said engine and disposed outwardly on opposite sides of the engine relative to the longitudinal center line and within said hull for achieving side to side balance.

2. A small watercraft as set forth in claim 1 wherein one of the supporting components comprises a water manifold for discharging exhaust gases from the engine and for precluding the entry of water through an exhaust system of the engine into the engine disposed on one side of the engine and an electrical system including a battery disposed on the other side of the engine.

3. A small watercraft as set forth in claim 2 further including a fuel tank disposed forwardly of the engine and having its center of gravity lying on the longitudinal center line of the watercraft.

4. A small watercraft as set forth in claim 3 wherein the components are arranged so that the center of gravity of the watercraft without a rider lies at its center in a horizontal plane.

* * * * *